United States Patent [19]

Smith et al.

[11] 4,105,451

[45] Aug. 8, 1978

[54] PHOTOTHERMOGRAPHIC MATERIAL, COMPOSITION AND PROCESS

[75] Inventors: James George Smith, Rochester; Ralph Clyde Reed, Hilton, both of N.Y.

[73] Assignee: Eastman Kodak Company, Rochester, N.Y.

[21] Appl. No.: 753,391

[22] Filed: Dec. 22, 1976

[51] Int. Cl.[2] ..... G03C 1/02; G03C 1/72; G03C 1/34

[52] U.S. Cl. ..... 96/66 T; 96/109; 96/114.1; 96/114.6

[58] Field of Search ..... 96/114.6, 131, 137, 96/114.1, 109

[56] References Cited

U.S. PATENT DOCUMENTS

| | | | |
|---|---|---|---|
| 2,410,690 | 11/1946 | Smith et al. | 96/131 X |
| 2,537,880 | 1/1951 | Dent, Jr. et al. | 96/131 X |
| 2,546,642 | 3/1951 | Koerber | 96/104 X |
| 3,369,902 | 2/1968 | Abbott | 96/137 X |
| 3,457,078 | 7/1969 | Riester | 96/104 |
| 3,549,379 | 12/1970 | Hellings et al. | 96/114.1 |
| 3,660,102 | 5/1972 | Riester | 96/127 |
| 3,669,672 | 6/1972 | Shiba et al. | 96/114.1 |
| 3,687,678 | 8/1972 | Riester | 96/122 |
| 3,785,830 | 1/1974 | Sullivan et al. | 96/114.1 |
| 3,832,186 | 8/1974 | Masuda et al. | 96/114.1 |
| 3,893,860 | 7/1975 | Sutton et al. | 96/114.1 X |

*Primary Examiner*—J. Travis Brown
*Assistant Examiner*—Alfonso T. Suro Pico
*Attorney, Agent, or Firm*—Richard E. Knapp

[57] ABSTRACT

An improved photothermographic material can be prepared by sequentially mixing the following components: (1) a dispersion comprising a 2-mercaptobenzothiazole, 2-mercaptobenzimidazole, 2-mercaptobenzoxazole or 2-mercaptobenzoselenazole compound and a silver salt of certain heterocyclic thiones with (2) a reducing agent solution, (3) a binder, and (4) a silver halide photosensitive composition containing a spectral sensitizing dye, such as a symmetrical or unsymmetrical thiosulfato substituted benzimidazolocarbocyanine dye. A photothermographic material containing the described components can provide a developed image after imagewise exposure by merely heating the material to moderately elevated temperatures.

39 Claims, No Drawings

PHOTOTHERMOGRAPHIC MATERIAL, COMPOSITION AND PROCESS

BACKGROUND OF THE INVENTION

1. Field of the Invention

This invention relates to a method of preparing an improved photothermographic material by mixing certain components including a silver salt of certain heterocyclic thione compounds in a particular series of steps. One aspect of the invention relates to a photothermographic element or composition comprising certain 2-mercapto compounds with certain silver salts of heterocyclic thione compounds and other components to provide a photothermographic material with a spectral sensitizing dye, particularly a symmetrical or unsymmetrical thiosulfatoalkyl substituted benzimidazolocarbocyanine dye. Another aspect of the invention relates to a method of providing a developed image in the described material by merely heating the material to moderately elevated temperatures.

2. Description of the State of the Art

Photothermographic materials comprising photosensitive silver halide in association with a silver salt of certain heterocyclic thione compounds and an organic reducing agent with a spectral sensitizing dye are known in the art. These photothermographic materials and methods of their preparation are described, for example, in U.S. Pat. No. 3,785,830 of Sullivan, Cole and Humphlett, issued Jan. 15, 1974 and U.S. Pat. No. 3,893,860 of Sutton and Stapelfeldt, issued July 8, 1975. One problem which has been encountered with these photothermographic materials is the need to provide increased spectral sensitivity. A significant limitation on the photothermographic materials described is the lack of range of spectral sensitizing dyes which can be effectively incorporated in the photothermographic materials. It is believed that one reason for difficulty in spectral sensitizing photothermographic materials containing such a silver salt of a heterocyclic thione has been the lack of an effective method of preparing the material that provides improved retention of the spectral sensitizing dye on the photosensitive silver halide used in the composition. Several methods have been attempted in order to improve this disadvantage.

Another problem which has been encountered in the described photothermographic materials centers on spectral sensitizing a preferred photosensitive silver halide in the photothermographic materials. This preferred silver halide is silver iodide and silver bromoiodide comprising up to 30 mole % iodide.

The use of spectral sensitizing dyes in photosensitive silver halide materials, especially silver halide photothermographic materials, are well known in the art. A variety of mercaptan compounds, thiones and thioethers have also been used in a variety of photothermographic materials in combination with spectral sensitizing dyes. For example, U.S. Pat. No. 3,617,289 of Ohkubo et al, issued Nov. 2, 1971 indicates that a thermally developed light-sensitive material, one that is not based on photosensitive silver halide with a silver salt of certain heterocyclic thione compounds, can be stabilized by treating the material with a solution containing certain thiol or thione compounds. These materials can contain spectral sensitizing dyes. U.S. Pat. No. 3,831,186 of Masuda et al, issued Aug. 27, 1974 relates to a heat developable photographic material containing silver benzotriazole with photosensitive silver halide and a reducing agent with a toning agent which is a specific thiol compound. A sensitizing dye can be present in this heat developable material, such as one containing a thiohydantoin moiety. This photothermographic material, however, is not based on the combination of photosensitive silver halide with a silver salt of a certain heterocyclic thione compound. None of the references describe an answer to the problem of providing a wider variety of dyes which are useful for spectral sensitizing a photothermographic composition containing silver salts of certain heterocyclic thione compounds with photosensitive silver halide, especially silver iodide.

Heterocyclic thione compounds have been used for a variety of purposes in photographic materials, such as photothermographic materials. For example, in U.S. Pat. No. 3,669,672 of Shiba et al, issued June 13, 1972, a silver halide photographic emulsion is spectrally sensitized with a combination of at least one pentamethine type cyanine dye with a certain heterocyclic compound which is a thione. The combination of the pentamethine dye with the heterocyclic compound is indicated as providing supersensitization of the silver halide emulsion. U.S. Pat. No. 3,687,678 of Reister, issued Aug. 29, 1972 indicates the sensitization of photographic silver halide can be provided by a combination of at least one xanthylium, thiaxanthylium or selenaxanthylium dye with certain concentrations of a certain isocyclic or heterocyclic aromatic mercapto compound. Also, U.S. Pat. No. 3,839,041 of Hiller, issued Oct. 1, 1974 describes a variety of heterocyclic thione compounds which are useful as stabilizer precursors in photothermographic materials. These can be used in combination with spectral sensitizing dyes. Mercapto compounds and selenol compounds are useful for supersensitizing conventional photographic silver halide materials as described, for example, in British Specification 1,229,951 published Apr. 28, 1971. 2-Mercaptobenzothiazole and 2-mercaptobenzoxazole compounds have also been used in photographic materials containing a photographic silver halide emulsion with a silver halide developing agent. This is described, for example, in British Specification 1,049,054 published Nov. 23, 1966. This combination, however, is used for developing an image by contacting the photographic material with an alkaline activator in processing solutions or baths, not by processing with heat. U.S. Pat. No. 3,776,738 of Ohlschlager et al, issued Dec. 4, 1973 also indicates that silver halide photographic emulsions can be sensitized with a combination of cyanine dyes and a mercapto or selenol compound. 2-Mercapto substituted heterocyclic compounds have also been used in gelatino silver halide photosensitive emulsions in an attempt to provide optimum sensitization during digestion in emulsion preparation. U.S. Pat. No. 3,785,822 of Overman, issued Jan. 15, 1974 which relates to this use, however, does not indicate that this combination is useful with photothermographic materials based on silver salts of certain heterocyclic thione compounds. None of these references have provided a satisfactory solution to the problem of providing increased spectral sensitization for a photothermographic material containing photosensitive silver halide with a silver salt of certain heterocyclic thione compounds and a reducing agent, as described, for instance, in U.S. Pat. No. 3,893,860 of Sutton and Stapelfeldt, issued July 8, 1975.

There has accordingly been a continuing need to provide improved spectral sensitization of photothermographic materials comprising photosensitive silver halide in association with silver salts of certain heterocyclic thione compounds, as described. There has also been a continuing need to provide improved methods for preparing the described photothermographic materials containing spectral sensitizing dyes to provide the desired increased sensitivity.

SUMMARY OF THE INVENTION

It has been found according to the invention that the described properties, including increased desired spectral sensitization, are provided in a photothermographic material by sequentially mixing the following components: (1) a dispersion comprising a 2-mercaptobenzothiazole, 2-mercaptobenzimidazole, 2-mercaptobenzoxazole or 2-mercaptobenzoselenazole compound and a silver salt of a heterocyclic thione represented by the formula:

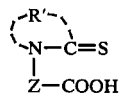

wherein R′ represents atoms completing a five-member heterocyclic nucleus and Z is alkylene containing 1 to 30 carbon atoms, with (2) a reducing agent solution, especially one comprising a polyhydroxybenzene reducing agent, as described herein, (3) a binder, preferably a polymeric binder, and (4) a silver halide photosensitive composition containing a spectral sensitizing dye, especially a spectral sensitizing dye that is a symmetrical or unsymmetrical thiosulfato substituted benzimidazolocarbocyanine dye.

An especially advantageous photothermographic element and composition according to the invention is one comprising in reactive association: (a) a 2-mercaptobenzothiazole, 2-mercaptobenzimidazole, 2-mercaptobenzoxazole or 2-mercaptobenzoselenazole compound, (b) a silver salt of a heterocyclic thione represented by the formula described, (c) a reducing agent, especially a polyhydroxybenzene reducing agent, (d) a binder, especially a polymeric binder as described herein, (e) a photosensitive silver halide emulsion, especially a photosensitive silver halide emulsion containing at least 30 mole percent iodide, and (f) a spectral sensitizing dye that is a symmetrical or unsymmetrical thiosulfatoalkyl substituted benzimidazolocarbocyanine dye, especially anhydro-5,5′-6,6′-tetrachloro-1,1′-diethyl-3,3′-bis(3-thiosulfatopropyl) benzimidazolocarbocyanine hydroxide, sodium salt. The described element and composition also preferably contains a toning agent, especially a mercapto heterocyclic toning agent as described herein.

A latent image can be provided in the described photothermographic materials according to the invention by imagewise exposing the photothermographic material to suitable exposure means and then merely heating the photothermographic material to provide a developed image. This provides the desired increased spectral sensitization and eliminates need for any additional processing steps. This development process can be carried out by contacting the photothermographic material with a suitable heating means to provide the desired processing temperature.

DETAILED DESCRIPTION OF THE INVENTION

A variety of 2-mercaptobenzothiazole, 2-mercaptobenzimidazole, 2-mercaptobenzoxazole and 2-mercaptobenzoselenazole compounds are useful in the described dispersion in preparing a photothermographic material according to the invention. The selection of an optimum 2-mercapto compound, as described, will depend upon various factors including the particular photothermographic material, the particular heterocyclic thione silver salt, the particular spectral sensitizing dye, desired image, and the like. A simple test can be useful for selecting an optimum 2-mercapto compound. For example, the 2-mercapto compound can be included in the composition as described in following Example 1 at the described concentration in order to determine if the desired spectral sensitization is achieved as in Example 3. An especially useful 2-mercapto compound is 2-mercapto-1,3-benzothiazole. The exact role which the described 2-mercapto compound plays in providing improved spectral sensitization of the described photothermographic materials according to the invention is not fully understood. However, it is believed that the 2-mercapto compound improves the degree of retention of the described spectral sensitizing dye on the photosensitive silver halide grains when in combination with other components of the photothermographic material. Examples of useful 2-mercapto compounds in the described dispersion and photothermographic material according to the invention include those within the following formula:

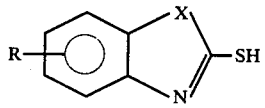

wherein R is selected from the group consisting of alkyl, especially alkyl containing 1 to 6 carbon atoms, such as methyl, ethyl, propyl, butyl and pentyl; aryl, especially aryl containing 6 to 12 carbon atoms, such as phenyl, halo, such as chloro, bromo and iodo; and X is selected from the group consisting of oxygen, sulfur, nitrogen and selenium atoms necessary to complete the heterocyclic nucleus. Examples of compounds which are useful as 2-mercapto compounds according to the invention include:

2-mercapto-1,3-benzothiazole,
5-chloro-2-mercapto-1,3-benzothiazole,
2-mercaptobenzimidazole, and
2-mercaptobenzoxazole.

Combinations of the desired 2-mercapto compounds can also be useful if desired.

A range of concentration of the desired 2-mercapto compounds can be useful in the method and materials according to the invention. The optimum concentration of 2-mercapto compound, as described, will depend upon the particular photothermographic composition, particular silver salt of the heterocyclic thione compound, particular sensitizing dye, processing conditions and the like. A typical concentration of 2-mercapto compound according to the invention is within the range of about $5.9 \times 10^{-6}$ mole to about $5.9 \times 10^{-4}$ mole of the described 2-mercapto compound per $m^2$ of support of the photothermographic material. An especially useful concentration is within the range of about $1 \times 10^{-5}$ mole to about $9 \times 10^{-5}$ mole of 2-mercapto-1,3-benzothiazole per $m^2$ of support of the described photothermographic material. When a combination of the described 2-mercapto compounds is used, the total concentration of the combination is within the described ranges. Corresponding concentrations of the 2-mercapto compound are used in compositions as described herein according to the invention.

A variety of silver salts of heterocyclic thione compounds are useful in the photothermographic materials according to the invention. A useful silver salt of a heterocyclic thione is a silver salt of a heterocyclic thione represented by the formula:

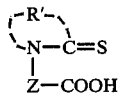

wherein R′ represents atoms necessary to complete a five-member heterocyclic nucleus, such as atoms selected from the group consisting of sulfur, nitrogen and oxygen atoms; and Z is alkylene containing 1 to 30 carbon atoms, typically 1 to 10 carbon atoms, such as methylene, ethylene, propylene and butylene. Combinations of the described heterocyclic thione silver salts can be useful. Selection of an optimum heterocyclic thione silver salt will depend upon such factors as the particular photothermographic material, particular toning agent, processing temperature, desired image, particular spectral sensitizing dye and the like. The term "salt" as used herein is intended to include various forms of bonding between the silver and the thione moieties, such as bonding which is present in a complex or salt that enables the silver moiety to effectively provide silver in the imaging process without significantly adversely affecting the desired sensitometric properties in the described photothermographic materials. Examples of useful five-member heterocyclic thione nuclei containing the described substitutents are thiazoline-2-thione, benzothiazoline-2-thione, imidazoline-2-thione, oxazoline-2-thione, and similar heterocyclic thione nuclei. The heterocyclic thione nucleus can contain substituent groups which do not adversely affect the photothermographic properties or other desired properties of the photothermographic material of the invention. Such substituent groups can include, for example, alkyl containing 1 to 3 carbon atoms, such as methyl, ethyl and propyl, or phenyl.

Especially useful thione compounds within the above formula are thiazoline-2-thiones represented by the formula:

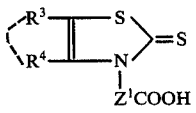

wherein $Z^1$ is alkylene containing 1 to 4 carbon atoms, such as methyl, ethyl, propyl and butyl; and $R^3$nd $R^4$are independently selected from the group consisting of hydrogen, alkyl containing 1 to 4 carbon atoms, such as methyl, ethyl, propyl, and butyl, or aryl containing 6 to 10 carbon atoms, such as phenyl or tolyl, or taken together are atoms necessary to complete a benzo group represented by the broken line between $R^3$ and $R^4$.

Other useful heterocyclic thione compounds within the above formula are imidazoline-2-thione compounds represented by the formula:

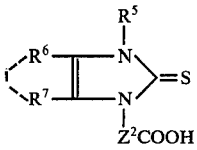

wherein $Z^2$ is alkylene containing 1 to 4 carbon atoms, such as methyl, ethyl, propyl and butyl; $R^6$ and $R^7$ are independently selected from the group consisting of hydrogen, alkyl containing 1 to 4 carbon atoms, such as methyl, ethyl, propyl and butyl, or aryl containing 6 to 10 carbon atoms, such as phenyl or tolyl, or taken together are atoms necessary to complete a benzo group represented by the broken line between $R^6$ and $R^7$; and $R^5$ is alkyl, typically alkyl containing 1 to 3 carbon atoms, such as methyl, ethyl and propyl, aryl containing 6 to 10 carbon atoms, such as phenyl, or carboxyalkyl such as carboxylalkyl containing 1 to 3 carbon atoms, for instance, carboxymethyl and carboxyethyl.

Other useful heterocyclic thione silver salts are silver salts of oxazoline-2-thione compounds represented by the formula:

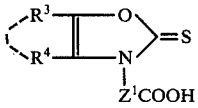

wherein $Z^1$, $R^3$ and $R^4$ are as defined.

In the definition of A, $A^1$, $Z^2$ and $Z^3$, alkylene is intended to include straight-chain alkylene and branch-chain alkylene groups.

Examples of useful heterocyclic thione compounds within the described formulae include:

3-(2-carboxyethyl)-4-methyl-4-thiazoline-2-thione
3-(2-carboxyethyl)benzothiazoline-2-thione
3-(2-carboxyethyl)-5-phenyl-1,3,4-oxadiazoline-2-thione
3-(2-carboxyethyl)-5-phenyl-1,3,4-thiadiazoline-2-thione
3-carboxymethyl-4-methyl-4-thiazoline-2-thione
3-(2-carboxyethyl)-1-phenyl-1,3,4-triazoline-2-thione
1,3-bis(2-carboxyethyl)imidazoline-2-thione
1,3-bis(2-carboxyethyl)benzimidazoline-2-thione
3-(2-carboxyethyl)-1-methylimidazoline-2-thione
3-(2-carboxyethyl)benzoxazoline-2-thione
3-(1-carboxyethyl)-4-methyl-4-thiazoline-2-thione A range of concentration of the described heterocyclic thione silver salt can be useful 5,5′the photothermographic material of the invention. The optimum concentration of heterocyclic thione silver salt will depend upon such factors as the particular components of the photothermographic material, the desired image, processing conditions and the like. Typically the concentration of heterocyclic thione silver salt is within the range of about $2.69 \times 10^{-3}$ to about $21.5 \times 10^{-3}$ mole/$m^2$ of support of a photothermographic element as described. An equivalent concentration of the heterocyclic thione silver salt is useful in a photothermograpic composition as described according to the invention. The ratio of silver to heterocyclic thione moiety in the described heterocyclic thione silver salt can vary depending upon such factors as the other components of the photothermographic material, the desired image, processing conditions, particular photosensitive silver salt, and the like. An optimum ratio will depend upon these factors for example. Typically, the ratio of thione compound to silver ion is less than about 2:1.

The silver salt of the described thione compound can be prepared directly in the photothermographic material as described by combining a source of silver ions, such as silver trifluoroacetate with the described thione compound in the composition. Preferably, however, the silver salt of the heterocyclic thione is preformed and isolated before addition to the photothermographic material to enable better control of the desired silver salt properties. The described thione compounds can be prepared using processes known in the art. It is desirable to avoid preparation of the silver salt in the presence of compound which cause undesired reduction.

Preparation of the thione compounds can be carried out employing procedures described, for example, in an article of R. W. Layman and W. J. Humphlett, Journal of Heterocyclic Chemistry, Volume 4, pages 605–609, 1967.

A variety of reducing agents are useful in the described method and composition of the invention to provide a desired photothermographic material. Especially useful reducing agents are polyhydroxybenzene reducing agents. These polyhydroxybenzene reducing agents are typically silver halide developing agents including, for example, such polyhydroxybenzenes as hydroquinone developing agents, for instance, hydroquinone, alkyl-substituted hydroquinones, such as tertiary-butylhydroquinone, methylhydroquinone, isopropylhydroquinone, 2,5-dimethylhydroquinone and 2,6-dimethylhydroquinone; catechols and pyrogallals; halo-substituted hydroquinone, such as chlorohydroquinone or dichlorohydroquinone; alkoxy-substituted hydroquinones such as methoxyhydroquinone or ethoxyhydroquinone and the like. Other silver halide developing agents can be useful alone or, typically, in combination with the described polyhydroxybenzene reducing agents. These other silver halide developing agents should not adversely affect the desired properties of the photothermographic composition. Other silver halide developing agents which can be useful include, for example, reductones, such as anhydrodihydropiperidinohexose reductone; hydroxytetronic acid developing agents and hydroxytetronimide developing agents; 3-pyrazolidone developing agents, such as 1-phenyl-3-pyrazolidone and 4-methyl-4-hydroxymethyl-1-phenyl-3-pyrazolidone; hydroxylamines; ascorbic acids such as ascorbic acids, ascorbic acid ketals and other ascorbic acid derivatives; aminophenols and the like. Combinations of developing agents can be useful. A suitable polyhydroxybenzene reducing agent, used alone or in combination with one or more of the described developing agents, is one which in the photothermographic materials according to the invention provides a developed image within about 90 seconds at a temperature within the range of about 100° to 200° C.

A range of concentration of the reducing agent can be useful in the photothermographic material of the invention. The optimum concentration of reducing agent will depend upon such factors as the particular components of the photothermographic material, including the particular heterocyclic thione silver salt, the desired image, processing conditions and the like. Typically, a concentration of reducing agent is within the range of about $2.69 \times 10^{-3}$ to about $21.5 \times 10^{-3}$ mole of reducing agent per $m^2$ support of a photothermograhic element as described. An equivalent concentration of reducing agent is used in a photothermographic composition as described. When a combination of reducing agents is used, the total concentration of the combination of reducing agents is within the described concentration ranges.

A variety of binders is useful in the described photothermograhic materials. The binders that are useful include various colloids alone or in combination as vehicles and/or binding agents. Useful materials can be hydrophilic or hydrophobic. The binders which are suitable include transparent or translucent materials and include both naturally-occurring substances such as proteins, for example, gelatin, gelatin derivatives, cellulose derivatives, polysaccharides such as dextran and the like; and, synthetic polymeric substances such as water soluble polyvinyl compounds like poly(vinyl pyrrolidone), acrylamide polymers and the like. Other synthetic polymeric binders which can be useful include dispersed vinyl compounds, such as in latex form. Those that are most useful increase dimensional stability of the photothermographic material. Suitable binders also include polymers that are water insoluble, such as polymers of alkylacrylates and methacrylates, acrylic acid, sulfoalkylacrylates or methacrylates, and those which have cross-linking sites that facilitate hardening or curing as well as those having recurring sulfobetaine units. Especially useful binding agents include high molecular weight materials and resins, such as poly(vinyl butyral), cellulose acetate butyrate, poly(methyl methacrylate), poly(vinyl pyrrolidone), ethylcellulose, poly(styrene), poly(vinyl chloride), chlorinated rubber, poly(isobutylene), butadiene-styrene copolymers, vinyl chloride-vinyl acetate copolymers, copolymers of vinyl acetate, vinyl chloride and maleic anhydride, poly(vinyl alcohol), and the like. Acrylamide polymers are especially useful, such as polyacrylamide and acrylamide copolymerized with, for example, 1-vinylimidazole, 2-methyl-1-vinylimidazole, 3-methyl-1-vinylimidazolium methylsulfate, N-methylolacrylamide, 2-acetoacetoxyethylmethacrylate, acrylic acid, 1-vinyl-2-pyrrolidone, 2-methyl-5-vinyl pyridine, and/or 1,2-dimethyl-5-vinylpyrridinium methylsulfate. It is important that the polymeric binder not adversely affect the sensitometric or other properties of the undescribed photothermographic material at the processing temperatures for the photothermographic material.

The suitable concentration of the binder can vary depending upon the particular binder, other components of the photothermographic material, processing conditions and the like.

Photothermographic elements according to the invention can comprise, if desired, multiple layers. For example, the photothermographic element can comprise an overcoat layer containing a polymer or combination of polymers, as described, and an additional overcoat layer comprising another polymer or combination of polymers, such as poly(vinyl alcohol). Further, the photothermographic layer can be coated on what is described as an undercoat layer, that is a layer between the photothermographic layer and the support in order to provide desired improved properties. The undercoat layer can be one or more of the described polymeric materials. More than one photothermographic layer can also be useful in a photothermographic element as described.

It is useful in some cases to include one or more of the components of the photothermographic composition in one or more of the described layers. For example, it can be useful in some instances to include a certain percentage of the described reducing agent in an overcoat and/or undercoat layer of a photothermographic element according to the invention. It is often useful to include a percentage of surfactant in each of the described layers.

A variety of surfactants can be useful in the described photothermographic materials of the invention. Useful surfactants are those which provide desired coating properties to the photothermographic materials and do not adversely affect the sensitometric or other desired properties of the material. Combinations of surfactants as described herein can be useful. Useful surfactants can be anionic, cationic, non-ionic or amphoteric. Useful anionic surfactants include, for example, those derived from sulfuric and sulfonic acids. The surfactant can be a cationic surfactant such as one derived from an amino group. The cationic surfactant can be hydrophilic having aliphatic and/or aromatic groups that can have varying polarity. Quaternary ammonium cationic surfactants can be useful. The surfactnat can be non-ionic and contain groups of varying polarity which render part of the surfactant lyophilic and part lyophobic. Examples of non-ionic surfactants include those derived from polyethylene glycol, poly(vinyl alcohol), polyethers, polyesters and polyhalides. Especially useful surfactants include glycidol ethers, such as a nonylphenoxyglycidol commercially available as Surfactant 10G from the Olin Corporation, U.S.A.

The concentration of surfactant which is useful in a photothermographic material, as described, can vary depending upon the particular components of the photothermographic material, desired coatability, the particular support, processing conditions, desired image and the like.

A variety of photosensitive silver halides can be useful in the described photothermographic material. Useful photographic silver halides include, for instance, silver chloride, silver bromide, silver iodide, silver bromoiodide, silver chlorobromoiodide, or mixtures thereof. The term "photographic silver halide" is intended to include silver halides which are photosensitive or photographic. The photographic silver halide can be coarse or fine grain, very fine grain silver halide being especially useful. The photographic silver halide can be prepared by any of the known procedures employed in the photographic art. The silver halide can be prepared, for example, employing single-jet preparation techniques or double-jet preparation techniques such as techniques employed in preparing Lippman emulsions and the like. Surface image silver halide can be useful. If desired, mixtures of surface and internal image silver halide can be used. Negative type silver halide is typically most useful. The silver halide can be regular grain silver halide, such as described in Klein and Moisar, Journal of Photographic Science, Volume 12, No. 5, September-October, 1964, pages 242–251. Photosensitive silver iodide is especially useful as the photographic silver halide.

The photosensitive silver halide can be washed or unwashed and can be chemically sensitized using techniques employed in the photographic art.

It is believed that the latent image formed in the photographic silver halide upon imagewise exposure of the photothermographic material increases the reaction rate between the components of the photothermographic material upon heating, especially the reaction that is believed to take place between the reducing agent and the silver salt of the described heterocyclic thione compound. This is believed to take place upon heating of the photothermographic material. It is believed that the latent image enables a lower processing temperature to be used for developing an image. The term "in association with" is intended to mean that the photosensitive silver halide and other components of the described photothermographic material are in a location with respect to each other that enables this lower processing temperature and provides a more useful developed image.

A variety of silver halide photosensitive compositions are useful according to the invention, especially photosensitive silver halide emulsions which include a peptizing agent and other addenda to help in preparation of the photothermographic composition. It is especially useful to have a gelatino silver halide emulsion as the silver halide photosensitive composition. This emulsion enables use of conventional silver halide emulsion technology in preparation of the described composition.

The spectral sensitizing dye in the described photothermographic material forms an important part of the material to confer additional sensitivity to the light-sensitive silver halide as described. The spectral sensitizing dye can be mixed with the silver halide photosensitive composition, for instance, by mixing the silver halide with a solution of the described dye in an organic solvent. Alternatively, the dye can be added in the form of a dispersion. Spectral sensitizing dyes which can be useful include the cyanines, merocyanines, complex-(trinuclear or tetranuclear) merocyanines, complex-(trinuclear or tetranuclear) cyanines, holopolar cyanines, styryls, hemicyanines, such as enamines, oxonols and hemioxonols. Examples of useful spectral sensitizing dyes include:

anhydro-3,3′-bis(3-carboxybutyl)-9-ethyl-5,5′-diphenyloxacarbocyanine hydroxide, sodium salt
anhydro-3,9-diethyl-5,5′-diphenyl-3′-(3-sulfopropyl-)oxacarbocyanine hydroxide
anhydro-11-ethyl-8,8′-dimethoxy-1,2′-bis(3-sulfopropyl)naphtho[1,2-d]oxazolocarbocyanine, sodium salt
3-ethyl-5{[3-(3-sulfopropyl)-2-benzoxaxolinylidene]-1-methylethylidene}-rhodanine
anhydro-1,3′-diethyl-5,5′-disulfonaphthol[1,2-d]oxazolo-oxocarbocyanine hydroxide, sodium salt
5-{Bis-[(3-ethyl-2-benzothiazolinylidene)methyl]methylene}-2-thiobarbituric acid
5,5′-6,6′-tetracloro-1,1′-bis(2-diethylaminoethyl)-3,3′-diethylbenzimidazolocarbocyanine iodide
5-[(3-ethyl-2-benzothiazolinylidene)-1-ethylethylidene]-2-thio-2,4-oxazolidinedione
5,5′-6,6′-tetrachloro-1,1′-diethyl-3,3′-diphenylbenzimidazolocarbocyanine chloride
3-Ethyl-5-{[1-(3-sulfopropyl)naphtho [1,2-D]-thiazolin-2-ylidene]-1-methylethylidene}-rhodanine
5,6-Dichloro-1,3,3′-triethyl-4-methyl-thiobenzimidazolothiocarbocyanine iodide
5,5′-6,6′-tetrachloro-1,1′-diethyl-3,3′-bis(3-hydroxypropyl)benzimidazolocarbocyanine chloride Combinations of spectral sensitizing dye can be useful.

Especially useful spectral sensitizing dyes in photothermograhic materials according to the invention are symmetrical or unsymmetrical thiosulfatoalkyl substituted benzimidazolocarbocyanine dyes such as anhydro-5,5'-6,6'-tetrachloro-1,1'-diethyl-3,3'-(3-thiosulfatopropyl)benzimidazolocarbocyanine hydroxide, sodium salt.

A range of concentration of spectral sensitizing dye or combinations of spectral sensitizing dyes can be useful in the described photothermographic materials. Typically, the concentration of spectral sensitizing dye is within the range of about 1 to 9 grams of dye per mole of silver halide. The optimum concentration of spectral sensitizing dye will depend upon such factors as the particular photothermographic composition, the particular silver halide, desired sensitivity, processing conditions and the like. An especially useful concentration of the described thiosulfatoalkyl substituted dye is within the range of about 3 to about 9 grams of the described dye per mole of silver halide.

The photothermographic materials according to the invention can contain a variety of addenda known to be useful in photothermographic materials, such as antistatic and/or conducting layers, plasticizers, lubricants, matting agents, brightening agents, light-absorbing materials, filter dyes, antihalation dyes, absorbing dyes, and the like.

It is often desirable to include a toning agent in the described photothermographic material in order to provide a more neutral tone (black) developed image. Useful toning agents include, for example, certain heterocyclic compounds which provide the desired neutral tone image. Examples of useful toning agents include 3-mercapto-1,2,4-triazole and 2,4-dimercaptopyrimidine. Combinations of toning agents can be useful. Examples of useful toning agents are described, for instance, in Research Disclosure, Sept. 1974, pages 34–36 published by Industrial Oportunities Ltd., Homewell, Havant, Hampshire, P09 1EF, UK.

The described components of the photothermographic materials of the invention can be added or otherwise mixed from water solutions or suitable organic solvents can be useful to aid in addition or mixing. The components can be mixed using various mixing means including homogeniziers, ultasonic mixing means and the like known in the photographic art.

It is desirable in some cases to include a hardener, especially an aldehyde hardener like formaldehyde, in the desscribed materials. This can provide, in some cases, improved incubation stability. A range of concentration of aldehyde hardener can be useful depending upon the particular polymeric binder, particular components of the photothermographic material, desired stability and the like. Typically, a concentration of about 0.01 to about 10%, such as about 0.1 to about 5% by weight of the described hardener is useful in the described polymeric binder. The hardener can be useful in any one or more of the layers of a photothermographic element according to the invention.

In a method of preparing a photothermographic composition, as described, the mixing steps can be carried out within a range of temperature. The optimum temperature for mixing of the described components will depend upon the particular components, coating conditions, desired image, and the like. Typically, a temperature is most useful for mixing that is within the range of about 50° C to about 90° C. The components that are used in the described mixing steps can be at a temperature within the range of temperatures that are useful for mixing as described. The time of mixing can also vary depending upon the described factors. The photothermographic conditions usually has increased sensitivity when the slver halide photosensitive composition containing the spectral sensitizing dye is heated for about 5 to about 30 minutes at a temperature within the range of about 50 to about 90° C before mixing it with other of the described components of the photothermographic material. The optimum time and temperature of this heating step will for the most part depend upon the particular silver halide and particular spectral sensitizing dye. In the case of a symmetrical or unsymmetrical thiosulfatoalkyl substituted benzimidazolocarbocyanine dye, the time and temperature for the described heating step will be within the range of about 5 to about 30 minutes at a temperature within the range of about 50° to 90° C. This is especially useful in the case of silver iodide as the photosensitive silver halide.

Mixing of the components as described in the process of the invention is usually carried out under atmospheric pressure.

An especially useful embodiment of the invention is a method of preparing a photothermographic composition comprising sequentially mixing the following components: (1) a dispersion comprising 2-mercaptobenzothiazole and a silver salt of 3-carboxymethyl-4-methyl-4-thiazoline-2-thione, with (2) a reducing agent solution comprising tertiary-butylhydroquinone or isopropylhydroquinone with a toning agent consisting essentially of a combination of 3-mercapto-1,2,4-triazole with 2,4-dimercaptopyrimidine, (3) a polymeric binder consisting essentially of poly(acrylamide-co-1-vinylimidazole), (4) a surfactant comprising a polyglycidol derivative, especially a paraisononylphenoxypolyglycidol and (5) a silver iodode photosensitive emulsion containing a spectral sensitizing dye consisting essentially of anhydro-5,5'6,6'-tetrachloro-1,1'-diethyl-3,3'-bis(3-thiosulfatopropyl)benzimidazolocarbocyanine hydroxide, sodium salt. It is especially useful in the described method to have the silver iodide photosensitive emulsion heated for about 5 to about 30 minutes at a temperature within the range of about 50° to about 90° C before mixing it with other of the described components. This provides additional increased spectral sensitivity to the photothermographic material.

The timebetween the described mixing steps according to the invention and the temperature at which the described components are held during this time can be selected to provide optimum desired properties, such as optimum spectral sensitization. This optimum time and temperature will depend upon a variety of factors, such as the particular compounds, the desired image, processing conditions and the like.

An especially useful composition prepared according to this method is a photothermographic composition comprising in reactive association: (a) 2-mercaptobenzothiazole, (b) a silver salt of 3-carboxymethyl-4-methyl-4-thiazoline-2-thione, (c) a reducing agent consisting essentially of tertiary-butylhydroquinone or isopropylhydroquinone, (d) a toning agent consisting essentially of a combination of 3-mercapto-1,2,4-triazole and 2,4-dimercaptopyrimidine, (e) a polymeric binder consisting essentially of poly(acrylamideco-1-vinylimidazole), (f) a photosensitive silver halide containig at least 25 mole % iodode, especially photosensitive silver iodide, and (g) a spectral sensitizing concentration of anhydro-5,5'-6,6'-tetrachloro-1,1'-diethyl3,3'-bis(3-thiosulfatopropyl)-benzimidazolocarbocyanine hydroxide, sodium salt that is within the range of 1gram to 9 grams of the dye per mole of the silver halide.

EXAMPLE 3

The procedure described in Examples 1 and 2 were repeated except that Part A (the silver complex dispersion) also contained 1 ml of a methanol solution containing 2% by weight of 2-mercapto-1,3-benzothiazole (0.012 g/m$^2$). The resulting photothermographic element was imagewise exposed, as described in Example 1, to provide a developable latent image which was then developed by heating the element also as described in Example 1. The results of this example are given in following Table II.

EXAMPLES 4–6

The procedures described in Examples 1–3 were repeated except that prior to addition of Part E to the composition, the mixture containing the dye and silver halide were heated for 15 minutes at 80° C. The results of these examples are given in following Table I.

The results of Example 6 indicate the surprising increased relative speed provided according to the invention.

While the exact mechanism involved in this result is not fully understood, it is believed that speed losses in the spectrally sensitized region, caused by incubation at elevated temperatures and humidity, are a result of dye being desorbed from the silver halide grains. These speed losses can be readily shown by exposing both fresh and incubated coatings to minus blue light, that is, tungsten light filtered by an appropriate filter which cuts off light below 460 nanometers. The sensitometric curves obtained after exposure and heat processing of such photothermographic materials provided data tributable solely to the spectral sensitized region of the silver halide emulsion.

Table I

| | | | ** Part E | | | | | | 1 week/37.8° C/50% RH | | | |
|---|---|---|---|---|---|---|---|---|---|---|---|---|
| | | | Sens. | | *Relative | Fresh | | | *Relative | | | |
| Ex. | **Part A | **Part B | Dye | ***15'/80° C | Speed | $\gamma$ | $D_{min}$ | $D_{max}$ | Speed | $\gamma$ | $D_{min}$ | $D_{max}$ |
| 1 | — | — | X | — | — | — | 0.12 | 0.18 | — | — | — | — |
| 2 | — | X | X | — | 100 | 0.63 | 0.04 | 0.60 | 50 | 0.58 | 0.04 | 0.40 |
| 3 | X | X | X | — | 427 | 0.65 | 0.04 | 0.88 | 209 | 0.61 | 0.04 | 0.78 |
| 4 | — | — | X | X | 436 | 0.39 | 0.10 | 0.58 | 398 | 0.45 | 0.08 | 0.62 |
| 5 | — | X | X | X | 692 | 0.76 | 0.06 | 0.99 | 501 | 0.88 | 0.04 | 1.05 |
| 6 | X | X | X | X | 725 | 0.98 | 0.04 | 1.01 | 708 | 0.84 | 0.06 | 1.06 |

*Measured at 0.30 above $D_{min}$; 4 seconds at 155° C processing; imagewise exposure was for 4 seconds with tungsten light with a filter which cuts off light below 460 nanometers.

**An X in the designated column means that the described component was present in the composition when coated on the support. A dash in the designated column means that the described component was absent from the composition. Part A refers to the described silver complex dispersion. Part B refers to the described reducing agent solution. Part E refers to the component containing silver iodide and the spectral sensitizing dye as described.

***This indicates in those examples noted with X that the component E containing the described dye was held for 15 minutes at 80° C prior to adding component E to the remainder of the described composition.

Examples 2 and 3 illustrate that the mercapto substituted compounds in the reducing agent solution (Part B) and/or the silver complex dispersion (Part A) provide improved spectral sensitivity of the described photothermographic materials.

Example 6 illustrates the surprising advantages of a material and method of preparing the material according to the invention. This photothermographic material provides evidence of desired increased maximum speed in the spectrally sensitized region (orthosensitization) and provides a minimum loss of speed upon incubation (about 0.01 log E).

Similar results to those described for Example 6 were obtained using one of the following compounds in place of 2-mercapto-1,3-benzotriazole:

EXAMPLE 7 — 5-chloro-2-mercaptobenzothiazole

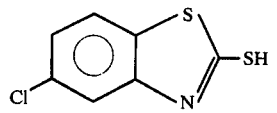

EXAMPLE 8 — 2-mercaptobenzimidazole

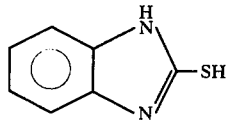

EXAMPLE 9 — 2-mercaptobenzoxazole

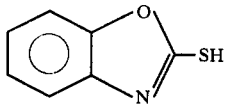

Each of the described 2-mercapto compounds can be useful when added either to the described dispersion or to the described developer solution; however, optimum results were observed with the procedure, as described in Example 6, in which the 2-mercapto compound was added to Part A.

The invention has been described in detail with particular reference to preferred embodiments thereof, but it will be understood that variations and modifications can be effected within the spirit and scope of the invention.

What is claimed is:

1. A method of preparing a photothermographic composition comprising sequentially mixing the following components:

(1) a dispersion comprising a 2-mercaptobenzothiazole, 2-mercaptobenzimidazole, 2-mercaptobenzoxazole or 2-mercaptobenzoselenazole compound and a silver salt of a heterocyclic thione represented by the formula:

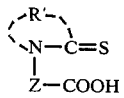

The photothermographic compositions according to the invention, can be coated ona wide variety of supports which can withstand the processing temperatures employed. Typical supports include cellulose ester film, poly(vinyl acetal) film, poly(ethylene terephthalate) film, polycarbonate film and related films or resinous materials, as well as glass, paper, metal and the like supports which can withstand the described processing temperatures. Typically, a flexible support is most useful, especially a paper support.

The photothermographic layer and/or other layers of a photothermographic element, according to the invention, can be coated by various coating procedures including dip coating, airknife coating, curtain coating or extrusion coating using hoppers. If desired, two or more layers can be coated simultaneously by procedures known in the art.

Various exposure means can be useful for providing an image in the described photothermographic materials according to the invention. Photothermographic materials according to the invention are typically sensitive to the UV and blue regions of the spectrum in the absence of the described spectral sensitizing dyes. The spectral sensitizing dyes can provide capability to use exposure means which include other than the UV and blue regions of the spectrum. Typically, a photothermographic material, according to the invention, is exposied imagewise to visible light, such as a tungsten light source. Other useful exposure means, however, include electron beam exposure means, lasers, X-rays and the like.

An image can be developed in a photothermographic element, as described, after imagewise exposure within a short time by heating the photothermographic element, preferably uniformly. For example, the photothermographic element containing a latent image can be heated to a temperature within the range of about 100° to about 200° C, preferably to a temperature within the range of about 140° to about 170° C until a desired image is developed. An image is typically developed within a short time, such as within about 1 to about 60 seconds. Increasing or decreasing the length of time of heating can enable use of a higher or lower temperature within the described temperature range.

A variety of means can be useful for providing the desired processing temperature. The heating means can be, for example, a simple hot plate, iron, roller, hot air convection heating means, dielectric heating means or the like.

One embodiment of the invention accordingly is a process of developing and stabilizing an image in a photothermographic element according to the invention comprising heating the element to a temperature within the described range until an image is developed and stabilized.

The following examples are included for a further understanding of the invention.

EXAMPLES 1-6

The following Examples 1-6 each used a photothermograhic element having the following layer arrangement:

| Layer | |
|---|---|
| III | Poly (acrylamide-co-l-vinylimidazole) (90:10) (1.08 g/m$^2$) + Surfactant 10G |
| II | Photothermographic Layer (0.75 g Ag/m$^2$) |
| I | Poly (acrylamide-co-1-vinylimidazole) (90:10) (1.08 g/m$^2$) + Surfactant 10G + formaldehyde (2%) |
| | Paper Support |

The described photothermographic layer is prepared as follows:

EXAMPLE 1

This is a comparative example.

a silver complex of 3-carboxymethyl-4-methyl4-thiazoline-2-thione was prepared as described in Example 22 of U.s. Pat. No. 3,785,830 of Sullivan, Cole and Humphlett, issued Jan. 15, 1974, the description of which is incorporated herein by reference. The molar ratio of complexing agent to silver ion was 1.6:1.

A photothermographic composition was prepared by combining the following Parts A-E in the order indicated respectively:

| | | |
|---|---|---|
| A. | Silver complex dispersion | 110 ml |
| B. | Reducing agent solution containing 3% by weight tertiary-butyl-hydroquinone in methanol | 35 ml |
| C. | Polymer solution consisting of 5% by weight poly(acrylamide-co-2-acetoacetoxyethyl methacrylate) in water | 12 ml |
| D. | Surfactant solution consisting of 10% by weight Surfactant 10G in water (Surfactant 10G is a nonylphenoxypolyglycidol available from the Olin Corp., USA) | 1 ml |
| E. | Photosensitive silver iodide emulsion peptized with gelatin containing a spectral sensitizing dye prepared by mixing 6 ml of gelatin peptized silver iodide emulsion (5.4 kilograms per mole of silver, 50 grams of gelatin per mole of silver) with 1 ml of a methanol solution containing 100 mg of anhydro-9-ethyl-5,5'-diphenyl-3,3'-di(3-sulfobutyl) monosodium salt per 30 ml of solvent. | 6 ml |

The resulting composition was stirred thoroughly and then coated on the described poly(acrylamide-co-1-vinylimidazole) layer and permitted to dry. It was then overcoated with layer III containing the described acrylamide copolymer. The resulting photothermographic element was sensitometrically exposed to provide a developable latent image. The resulting image was developed by heating the photothermographic element for 4 seconds at 155° C.

EXAMPLE 2

This is a comparative example.

The procedure described in Example 1 was repeated except that Part B (the reducing agent solution) also contained 0.015% by weight of 2-mercapto-1,2,4-triazole (0.0094 grams/m$^2$) and 0.004% by weight of 2,4-dimercaptopyrimidine (0.0024 g/m$^2$) to provide improved developed image tone. The resulting photothermographic element was imagewise exposed to provide a developable latent image and then heated as described in Example 1 to provide a developed image. The results of Examples 1 and 2 are given in following Table I.

wherein R′ represents atoms completing a five-member heterocyclic nucleus and Z is alkylene containing 1 to 30 carbon atoms, (2) a reducing agent solution comprising a reducing agent, (3) a binder, and (4) a silver halide photosensitive composition containing a spectral sensitizing dye.

2. A method as in claim 1 wherein said silver halide contains at least 30 mole percent iodide.

3. A method as in claim 1 wherein said silver halide consists essentially of silver iodide.

4. A method as in claim 1 wherein said surfactant consists essentially of a paraisononylphenoxypolyglycidol surfactant.

5. A method as in claim 1 wherein said binder consists essentially of an acrylamide polymer.

6. A method as in claim 1 wherein said binder is an acrylamide polymer selected from the group consisting of poly(acrylamide), poly(acrylamide-co-2-acetoacetoxyethyl methacrylate), poly(acrylamide-co-α-chloroacrylic acid), poly(acrylamide-co-1-vinylimidazole), poly(vinyl alcohol), and combinations thereof.

7. A method as in claim 1 wherein said component (2) also comprises a toning agent that is a combination of 3-mercapto-1,2,4-triazole and 2,4-dimercaptopyrimidine.

8. A method as in claim 1 wherein said reducing agent is a polyhydroxybenzene reducing agent.

9. A method as in claim 1 wherein said silver salt of a heterocyclic thione consists essentially of a silver salt of 3-carboxymethyl-4-methyl-4-thiazoline-2-thione.

10. A method as in claim 1 also comprising heating said silver halide photosensitive composition containing a spectral sensitizing dye for about 5 to about 30 minutes at a temperature within the range of about 50 to about 90° C before mixing it with other of said components.

11. A method of preparing a photothermographic composition comprising sequentially mixing the following components:

(1) a dispersion comprising a 2-mercaptobenzothiazole,2-mercaptobenzimidazole, 2-mercaptobenzoxazole or 2-mercaptobenzoselenazole compound and a silver salt of a heterocyclic thione represented by the formula:

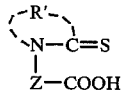

wherein R′ represents atoms completing a five-member heterocyclic nucleus and Z is alkylene containing 1 to 30 carbon atoms, (2) a reducing agent solution comprising a reducing agent, (3) a binder, and (4) a silver halide photosensitive composition containing a spectral sensitizing dye consisting essentially of a symmetrical or unsymmetrical thiosulfatoalkyl substituted benzimidazolocarbocyanine dye.

12. A method as in claim 11 wherein said spectral sensitizing dye consists essentially of anhydro-5,5′-6,6′-tetrachloro-1,1′-diethyl-3,3′-bis(thiosulfatopropyl)-benzimidazolocarbocyanine hydroxide, sodium salt.

13. A method as in claim 11 wherein said photosensitive composition contains a spectral sensitizing concentration of said spectral sensitizing dye that is within the range of about 1 g to about 9 g of said spectral sensitizing dye per mole of said silver halide.

14. A method as in claim 11 wherein said halide contains at least 30 mole percent iodide.

15. A method as in claim 11 wherein said halide consists essentially of silver iodide.

16. A method as in claim 11 wherein said binder consists essentially of an acrylamide polymer.

17. A method as in claim 11 wherein said binder is an acrylamide polymer selected from the group consisting of poly(acrylamide), poly(acrylamide-co-2-acetoacetoxyethyl methacrylate), poly(acrylamide-co-α-chloroacrylic acid), poly(acrylamide-co-1-vinylimidazole), poly(vinyl alcohol), and combinations thereof.

18. A method as in claim 11 wherein said component (2) also comprises a toning agent that is a combination of 3-mercapto-1,2,4-triazole and 2,4-dimercaptopyrimidine.

19. A method as in claim 11 wherein said silver salt of a heterocyclic thione consists essentially of a silver salt of 3-carboxymethyl-4-methyl-4-thiazolidine-2-thione.

20. A method of preparing a photothermographic composition comprising sequentially mixing the following components:

(1) a dispersion comprising 2-mercaptobenzothiazole and a silver salt of 3-carboxymethyl-4-methyl-4-thiazoline-2-thione, (2) a reducing agent solution comprising t-butylhydroquinone or isopropylhydroquinone with a toning agent consisting essentially of a combination of 3-mercapto-1,2,4-triazole with 2,4-dimercaptopyrimidine, (3) a polymeric binder consisting essentially of poly(acrylamide-co-1-vinylimidazole), (4) a para-isononylphenoxypolyglycidol surfactant, and (5) a silver iodide photosensitive emulsion containing a spectral sensitizing dye consisting essentially of anhydro-5,5′-6,6′-1,1′-diethyl-3,3′-bis(3-thiosulfatopropyl)-benzimidazolocarbocyanine hydroxide, sodium salt.

21. A method as in claim 20 wherein said silver iodide photosensitive emulsion is heated for about 5 to about 30 minutes at a temperature within the range of about 50° to about 90° C before mixing it with other of said components.

22. A photothermographic element comprising a support having thereon in reactive association:

(a) a 2-mercaptobenzothiazole, 2-mercaptobenzimidazole, 2-mercaptobenzoxazole or 2-mercaptobenzoselenazole compound, (b) a silver salt of a heterocyclic thione represented by the formula:

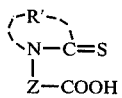

wherein R′ represents atoms completing a five-member heterocyclic nucleus and Z is alkylene containing 1 to 30 carbon atms, (c) a reducing agent, (d) a binder, (e) a photosensitive silver halide emulsion, and (f) a spectral sensitizing dye that is a symmetrical or unsymmetrica thiosulfatoalkyl substituted benzimidazolocarbocyanine dye.

23. A photothermographic element as in claim 22 comprising a spectral sensitizing concentration of said dye that is within the range of about 1 g to about 9 g of said spectral sensitizing dye per mole of said silver halide.

24. A photothermographic composition comprising:

(a) a 2-mercaptobenzothiazole, 2-mercaptobenzimidazole, 2-mercaptobenzoxazole or 2-mercaptobenzoselenazole compound, (b) a silver salt of a heterocyclic thione represented by the formula:

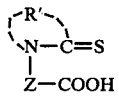

wherein R′ represents atoms completing a five-member heterocyclic nucleus and Z is alkylene containing 1 to 30 carbon atoms, (c) a reducing agent, (d) a binder, (e) a photosensitive silver halide emulsion, and (f) a spectral sensitizing dye that is a symmetrical or unsymmetrical thiosulfatoalkyl substituted benzimidazolocarbocyanine dye.

25. A photothermographic composition as in claim 24 wherein said dye is anhydro-5,5′-6,6′-tetrachloro-1,1′-diethyl-3,3′-bis(3-thiosulfatopropyl)-benzimidazolocarbocyanine hydroxide, sodium salt.

26. A photothermographic composition as in claim 24 comprising a spectral sensitizing concentration of said dye that is within the range of about 1 g to about 9 g of said dye per mole of said silver halide.

27. A photothermographic composition as in claim 24 wherein said silver halide contains at least 30 mole percent iodide.

28. A photothermographic composition as in claim 24 wherein said silver halide consists essentially of silver iodide.

29. A photothermographic composition as in claim 24 also comprising a polyglycidol surfactant.

30. A photothermographic composition as in claim 24 also comprising a para-isononylphenoxypolyglycidol surfactant.

31. A photothermographic composition as in claim 24 wherein said binder consists essentially of an acrylamide polymer.

32. A photothermographic composition as in claim 24 wherein said binder is an acrylamide polymer selected from the group consisting of poly(acrylamide), poly(acrylamide-co-2-acetoacetoxyethyl methacrylate), poly (acrylamide-co-α-chloroacrylic acid), poly(acrylamide-co-1-vinylimidazole), poly(vinyl alcohol), and combinations thereof.

33. A photothermographic composition as in claim 24 wherein said reducing agent consists essentially of t-butylhydroquinone or isopropylhydroquinone.

34. A photothermographic composition as in claim 24 wherein said silver salt of a heterocyclic thione consists essentially of a silver salt of 3-carboxymethyl-4-methyl-4-thiazoline-2-thione.

35. A photothermographic composition comprising:

(a) 2-mercaptobenzothiazole, (b) a silver salt of 3-carboxymethyl-4-methyl-4-thiazoline-2-thione, (c) a reducing agent consisting essentially of t-butylhydroquinone or isopropylhydroquinone, (d) a toning agent consisting essentially of a combination of 3-mercapto-1,2,4-triazole and 2,4-dimercaptopyrimidine, (e) a polymeric binder consisting essentially of poly(acrylamide-co-1-vinylimidazole), (f) a photosensitive silver halide containing at least 30 mole percent iodide, and (g) a spectral sensitizing concentration of anhydro-5,5′-6,6′-tetrachloro-1,4′-diethyl-3,3′-bis(3-thiosulfatopropyl)-benzimidazolocarbocyanine hydroxide, sodium salt that is within the range of 1 g to 9 g of said dye per mole of said silver halide.

36. A photothermographic element comprising a support having thereon a layer comprising:

(a) 2-mercaptobenzothiazole, (b) a silver salt of 3-carboxymethyl-4-methyl-4-thiazoline-2-thione, (c) a reducing agent consisting essentially of t-butylhydroquinone or isopropylhydroquinone, (d) a toning agent consisting essentially of a combination of 3-mercapto-1,2,4-triazole and 2,4-dimercaptopyrimidine, (e) a polymeric binder consisting essentially of poly(acrylamide-co-1-vinylimidazole), (f) a photosensitive silver halide containing at least 30 mole percent iodide, and (g) a spectral sensitizing concentration of anhydro-5,5′-6,6′-tetrachloro-1,1′-diethyl-3,3′-bis(3-thiosulfatopropyl)-benzimidazolocarbocyanine hydroxide, sodium salt that is within the range of 1 g to 9 g of said dye per mole of said silver halide.

37. A photothermographic element comprising a support having thereon a layer comprising (a) a 2-mercaptobenzothiazole, 2-mercaptobenzimidazole, 2-mercaptobenzoxazole or 2-mercaptobenzoselenazole compound, (b) a silver salt of a heterocyclic thione represented by the formula:

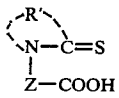

wherein R′ represents atoms completing a five-member heterocyclic nucleus and Z is alkylene containing 1 to 30 carbon atoms, (c) a reducing agent, (d) a binder, (e) a photosensitive silver halide emulsion, and (f) a spectral sensitizing dye containing essentially of anhydro-5,5′-6,6′-tetrachloro-1,4′-diethyl-3,3′-bis(3-thiosulfatopropyl)-benzimidazolocarbocyanine hydroxide, sodium salt.

38. A process of developing and stabilizing an image in an imagewise exposed photothermographic element comprising a support having thereon a layer comprising (a) a 2-mercaptobenzothiazole, 2-mercaptobenzimidazole, 2-mercaptobenzoxazole or 2-mercaptobenzoselenazole compound, (b) a silver salt of a heterocyclic thione represented by the formula:

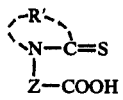

wherein R′ represents atoms completing a five-member heterocyclic nucleus and Z is alkylene containing 1 to 30 carbon atoms, (c) a reducing agent,
(d) a binder,
(e) a photosensitive silver halide emulsion, and
(f) a spectral sensitizing dye that is a symmetrical or unsymmetrical thiosulfatoalkyl substituted benzimidazolocarbocyanine dye comprising heating said element to a temperature within the range of about 100° to about 200° C until an image is developed and stabilized.

39. A process of developing and stabilizing an image in an imagewise exposed photothermographic element comprising a support having thereon a layer comprising (a) 2-mercaptobenzothiazole,
(b) a silver salt of 3-carboxymethyl-4-methyl-4-thiazoline-2-thione,
(c) a reducing agent consisting essentially of t-butylhydroquinone or isopropylhydroquinone,
(d) a toning agent consisting essentially of a combination of 3-mercapto-1,2,4-triazole and 2,4-dimercaptopyrimidine,
(e) a polymeric binder consisting essentially of poly(acrylamide-co-1-vinylimidazole),
(f) a photosensitive silver halide containing at least 30 mole percent iodide, and
(g) a spectral sensitizing concentration of anhydro-5,5′-6,6′-tetrachloro-1,1′-diethyl-3,3′-bis(3-thiosulfatopropyl)-benzimidazolocarbocyanine hydroxide, sodium salt that is within the range of 1 g to 9 g of said dye per mole of said silver halide comprising heating said element to a temperature within the range of about 140° to about 170° C until an image is developed and stabilized.

* * * * *

UNITED STATES PATENT AND TRADEMARK OFFICE

CERTIFICATE OF CORRECTION

PATENT NO. : 4,105,451

DATED : August 8, 1978

INVENTOR(S) : James G. Smith and Ralph C. Reed

It is certified that error appears in the above-identified patent and that said Letters Patent are hereby corrected as shown below:

Column 4, line 54, "desired" should read ---described---; line 56, "desired" should read ---described---.

Column 5, line 41, "substitutents" should read ---substituents---.

Column 6, line 23, "carboxylalkyl" should read ---carboxyalkyl---; line 36, " A,A' " should read --- Z,Z' ---; line 55, after "useful" delete " 5,5' " and before "the" insert ---in---; line 65, "photothermograpic" should read ---photothermographic---.

Column 7, line 18, "compound" should read ---compounds---; line 35, "pyrogallals" should read ---pyrogallols---.

Column 8, lines 2-3, "photothermograhic" should read ---photothermographic---; lines 9-10, "photothermograhic" should read ---photothermographic---; lines 47-48, "undescribed" should read ---described---.

Column 9, line 24, "surfactnat" should read ---surfactant---; line 53, "Lippman" should read ---Lippmann---.

UNITED STATES PATENT AND TRADEMARK OFFICE

CERTIFICATE OF CORRECTION

PATENT NO. : 4,105,451

DATED : August 8, 1978

INVENTOR(S) : James G. Smith and Ralph C. Reed

It is certified that error appears in the above-identified patent and that said Letters Patent are hereby corrected as shown below:

Column 10, line 43, that part of the formula reading " 1,2'-bis " should read --- 1,1'-bis ---; line 46, that part of the formula reading " 2-benzoxaxolinylidene]- " should read --- 2-benzoxazolinylidene]- ---; line 48, " disulfonaphthol[1,2-d] " should read --- disulfonaphtho[1,2-d] ---; line 49, "oxocarbocyanine" should read ---oxacarbocyanine---; line 52, " tetracloro-1,1'-bis " should read --- tetrachloro-1,1'-bis ---; line 64, "dye" should read ---dyes---; lines 66-67, "photothermograhic" should read ---photothermographic---.

Column 11, line 2, should read --- dro-5,5'-6,6'-tetrachloro-1,1'-diethyl-3,3'-bis(3-thiosulfato- ---; line 35, "Oportunities" should read ---Opportunities---; line 42, "homogeniziers" should read ---homogenizers--- and "ultasonic" should read ---ultrasonic---; line 46, "desscribed" should read ---described---.

Column 12, line 2, "slver" should read ---silver---; line 44, "timebetween" should read ---time between---; line 61, that part of the formula reading " poly(acrylamideco-1- " should read --- poly(acrylamide-co-1- ---; line 62, "containig" should read ---containing---; line 63, "iodode" should read ---iodide---; line 65, should read as follows --- 5,5'-6,6'-tetrachloro-1,1'-diethyl-3,3'-bis(3-thiosulfato- ---.

UNITED STATES PATENT AND TRADEMARK OFFICE

CERTIFICATE OF CORRECTION

PATENT NO. : 4,105,451

DATED : August 8, 1978

INVENTOR(S) : James G. Smith and Ralph C. Reed

It is certified that error appears in the above-identified patent and that said Letters Patent are hereby corrected as shown below:

Column 13, line 2, "ona" should read ---on a---; line 27, "exposied" should read ---exposed---; lines 60-61, "photothermograhic" should read ---photothermographic---.

Column 14, line 12, "a silver" should read ---A silver--- and " 3-carboxymethyl-4-methyl4- " should read --- 3-carboxymethyl-4-methyl-4- ---; line 14, "U.s." should read ---U.S.---; line 43, after "sulfobutyl)" insert --- oxacarbocyanine hydroxide, ---.

Column 18, line 42, after "6,6'-" insert --- tetrachloro- ---; line 65, "atms" should read ---atoms---.

Column 19, line 2, "unsymmetrica" should read ---unsymmetrical---.

Column 20, line 13, that part of the formula reading " 1,4' " should read --- 1,1' ---; line 57, that part of the formula reading " 1,4' " should read --- 1,1' ---.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*